US009170043B2

(12) United States Patent
Choo et al.

(10) Patent No.: US 9,170,043 B2
(45) Date of Patent: Oct. 27, 2015

(54) REFRIGERATOR

(71) Applicant: LG Electronics Inc., Seoul (KR)

(72) Inventors: Ayoung Choo, Gyeongnam (KR); Taegyeong Kim, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 6 days.

(21) Appl. No.: 14/070,730

(22) Filed: Nov. 4, 2013

(65) Prior Publication Data

US 2014/0125212 A1 May 8, 2014

(30) Foreign Application Priority Data

Nov. 5, 2012 (KR) ..... 10-2012-0124198

(51) Int. Cl.

| | |
|---|---|
| ***A47B 67/02*** | (2006.01) |
| ***A47B 96/04*** | (2006.01) |
| ***F25D 23/00*** | (2006.01) |
| ***F25D 25/02*** | (2006.01) |

(52) U.S. Cl.

CPC ..... *F25D 23/00* (2013.01); *F25D 25/025* (2013.01)

(58) Field of Classification Search

CPC ..... A47B 51/00; A47B 46/00; A47B 46/005; A47B 88/04; A47B 88/06

USPC ..... 312/246, 247, 248, 323, 408

See application file for complete search history.

(56) References Cited

U.S. PATENT DOCUMENTS

| | | | | | |
|---|---|---|---|---|---|
| 264,748 | A | * | 9/1882 | Potts | 312/201 |
| 876,159 | A | * | 1/1908 | Erikson | 312/248 |
| 1,137,074 | A | * | 4/1915 | Morris | 312/323 |
| 2,926,507 | A | * | 3/1960 | Ingolia | 62/377 |
| 3,224,827 | A | * | 12/1965 | Foster et al. | 312/266 |
| 3,866,866 | A | * | 2/1975 | Kneile | 248/660 |
| 4,076,351 | A | * | 2/1978 | Wyant | 312/247 |
| 4,160,571 | A | * | 7/1979 | Bigotti | 312/327 |
| 4,725,108 | A | * | 2/1988 | Wilson | 312/323 |
| 5,011,239 | A | * | 4/1991 | Guerin | 312/248 |
| 5,058,846 | A | * | 10/1991 | Close | 248/284.1 |
| 5,224,677 | A | * | 7/1993 | Close | 248/292.11 |
| 5,242,219 | A | * | 9/1993 | Tomaka | 312/245 |
| 5,758,782 | A | * | 6/1998 | Rupert | 211/99 |
| 5,857,756 | A | * | 1/1999 | Fehre | 312/246 |
| 5,871,107 | A | * | 2/1999 | Johnson et al. | 211/104 |

(Continued)

FOREIGN PATENT DOCUMENTS

| | | | |
|---|---|---|---|
| CN | 2531336 | Y | 1/2003 |
| CN | 2847183 | Y | 12/2006 |

(Continued)

OTHER PUBLICATIONS

Chinese Office Action dated Jun. 25, 2015 for Chinese Appln. No. 201310540898.7, with English Translatin, 9 pages.

*Primary Examiner* — Daniel J Troy
*Assistant Examiner* — Kimberley S Wright
(74) *Attorney, Agent, or Firm* — Fish & Richardson P.C.

(57) ABSTRACT

There is disclosed a refrigerator including a refrigerator cabinet comprising a storage chamber provided therein, a first drawer provided in the storage chamber, movable forward, a second drawer arranged in front of the first drawer, movable forward and downward, a rail unit configured to support the first drawer and the second drawer and guide the motion of the first and second drawers, and a link unit comprising a shaft coupled to the second drawer, to rotate the second shelf forward and downward.

20 Claims, 7 Drawing Sheets

(56) References Cited

U.S. PATENT DOCUMENTS

| | | | | |
|---|---|---|---|---|
| 6,039,422 | A * | 3/2000 | Butters et al. | 312/334.1 |
| 7,770,986 | B1 * | 8/2010 | Simaitis | 312/247 |
| 8,424,693 | B1 * | 4/2013 | Hoover | 211/55 |
| 8,641,156 | B2 * | 2/2014 | Chow | 312/247 |
| 2009/0179538 | A1 * | 7/2009 | Greenberg | 312/237 |
| 2011/0234067 | A1 * | 9/2011 | Vicek | 312/249.1 |
| 2011/0255943 | A1 * | 10/2011 | L'Ecuyer | 414/541 |
| 2011/0266936 | A1 * | 11/2011 | Moran | 312/312 |
| 2012/0194042 | A1 * | 8/2012 | Greenberg | 312/107 |
| 2012/0313494 | A1 * | 12/2012 | Chow | 312/298 |
| 2013/0257242 | A1 * | 10/2013 | Bunch | 312/249.7 |
| 2014/0001425 | A1 * | 1/2014 | Falcon | 254/133 R |

FOREIGN PATENT DOCUMENTS

| | | | |
|---|---|---|---|
| CN | 2890796 | Y | 4/2007 |
| CN | 201177430 | Y | 1/2009 |

* cited by examiner

REFRIGERATOR

Pursuant to 35 U.S.C. §119(a), this application claims the benefit of earlier filing date and right of priority to Korean Application No. 10-2012-0124198, filed on Nov. 5, 2012, the contents of which are hereby incorporated by reference herein in their entirety.

BACKGROUND OF THE DISCLOSURE

1. Field of the Disclosure

The present invention relates to a refrigerator more particularly, to a refrigerator including a drawer provided beyond a storage compartment, with being movable forward and downward.

2. Discussion of the Related Art

Generally, a refrigerator is an electric appliance which exhausts cold air generated by a freezing cycle configured of a compressor, a condenser, an expansion valve and an evaporator to lower a temperature inside so as to freeze or refrigerate foods.

Such a refrigerator typically includes a freezer compartment for storing foods or drinks in a frozen state and a refrigerator compartment for storing the foods or drinks in low temperatures. A Kim-chi refrigerator for preserving foods (e g, Kim-chi) or vegetables in a fresh state may be a type of a refrigerator.

At least one of the doors coupled to the refrigerator is connected to a cabinet of the refrigerator by a hinge and rotatable to open and close a front of the case. Rather than the door rotated by the hinge, another door is coupled to a front of a drawer to be retractable together with the drawer.

Typically, the refrigerator may be classified into a top mount type refrigerator, a bottom freezer type refrigerator and a side by side type refrigerator. In the top mount type refrigerator, a freezer compartment is arranged in a top and a refrigerator compartment is arranged in a bottom. In the bottom freezer tope, the refrigerator compartment is arranged in the top and the freezer compartment is arranged in the bottom. In the side by side type, the freezer and refrigerator compartments are arranged side by side.

In recent, the refrigerators have been enlarged to store more foods.

Accordingly, the height of the refrigerators is increasing and refrigerators are likely to be higher than an average height of adults. A traverse depth of a storage chamber increasing in such a large refrigerator.

Especially, in the side by side refrigerator, foods stored in a top area of a refrigerator or freezer compartment, particularly, foods stored in a back area cannot be reached by a user and it is difficult to put in or take out the foods.

Even in the bottom freezer type refrigerator, a space of the refrigerator compartment is partitioned off into right and left spaces by a partition wall and a pair of doors are rotatably coupled to the right and left spaces.

At this time, it is also difficult to put in or take out the foods stored in top areas of the right and left spaces.

SUMMARY OF THE DISCLOSURE

Exemplary embodiments of the present disclosure provide a refrigerator including a drawer provided in a top area of a freezer or refrigerator compartment thereof for a user to put in or take out foods stored in the top area easily and conveniently.

To achieve these objects and other advantages and in accordance with the purpose of the invention, as embodied and broadly described herein, a refrigerator includes a refrigerator cabinet; a storage chamber located within the refrigerator cabinet; a first drawer located in the storage chamber at a rear retracted position and configured to move to a rear extended position by moving forward in a direction toward a front of the storage chamber; a second drawer arranged in front of the first drawer at a front retracted position and configured to move to a front extended position by moving forward in a direction toward the front of the storage chamber and downward in a direction toward a bottom of the storage chamber; a rail unit configured to support the first drawer and the second drawer and guide movement of the first drawer and the second drawer; and a link unit comprising a shaft coupled to the second drawer, the link unit being configured to pivot the second drawer forward and downward to the front extended position.

The link unit may include a first link connected between a rear lower portion of a lateral wall of the first drawer and a rear upper portion of a lateral wall of the second drawer; and a second link connected between a front lower portion of the lateral wall of the first drawer and a front upper portion of the lateral wall of the second drawer.

The first link may be bent upward in a convex manner and the second link is bent downward in a convex manner.

The first drawer may include a first stopper configured to restrict a rotation angle through which the first link is able to rotate downward, and the second drawer comprises a second stopper configured to restrict a rotation angle through which the second link is able to rotate downward.

The second drawer may include a damper configured to dampen a shock generated by rotation of the second link that occurs based on the second drawer moving forward and downward to the front extended position.

The second link may further include a concave portion configured to support one end of the first link based on the second drawer being moved forward and downward to the front extended position.

The first drawer may include a first roller that is inserted in and supported by the rail unit.

The rail unit may include a guide groove defined in an inner surface of the rail unit, the guide groove being configured to receive and guide the first roller.

The second drawer may include a second roller supported by an upper surface of the rail unit.

The rail unit may further include a stopper located at one end thereof and configured to restrict forward movement of the first roller at a maximum forward position of the first roller.

The rail unit may further include an inclined curvature at a front end of the rail unit, the inclined curvature being configured to guide movement of the second roller as the second roller moves downward based on the second drawer moving to the front extended position.

The first link and the second link may be located at outer lateral surfaces of the first drawer and the second drawer, and the first drawer and the second drawer may include a first cover and a second cover configured to cover the first link and the second link, respectively, and the first cover and the second cover may be configured to avoid interference with the first link and the second link, respectively.

The link unit may include two links that are oriented in parallel to each other and that are connected between an outer lateral surface of the second drawer and an inner lateral surface of the rail unit.

The link unit may include a first link connected between a rear upper portion of a lateral surface of the second drawer and an inner lateral surface of a middle portion of the rail unit;

and a second link connected between a front upper portion of the lateral surface of the second drawer and a front inner lateral surface of the rail unit, the second link being oriented in parallel to the first link and arranged lower than the first link.

The rail unit may include a supporting projection configured to support the second link based on the second drawer being moved forward and downward to the front extended position.

The first drawer may include a plurality of rollers supported by the rail unit.

A guide groove may be defined in the rail unit, the guide groove being configured to receive the plurality of the rollers and the guide groove being inclined a predetermined angle forward.

The second drawer may include damper configured to dampen rotation force of the second link based on the second drawer being moved forward and downward to the front extended position.

The second drawer may further include a cover located at an outer lateral surface thereof and configured to cover a portion of the link unit and the damper.

The first drawer and the second drawer each may have a rectangular box shape with an open top, and portions of front surfaces of the first drawer and the second drawer may be open.

According to the refrigerator of the present disclosure, the drawer movable forward and downward may be provided in the upper portion of the storage chamber. Accordingly, the user can place foods in the upper portion inside the storage chamber which is difficult for the user to reach easily or take out the stored from the upper portion easily.

Furthermore, the drawer movable forward and downward may be provided in the front upper portion of the storage chamber and another drawer movable forward may be provided behind the drawer. Accordingly, it is easy for the user to have access to the upper front and rear portions inside the storage chamber so as to place or take out the foods in and from the upper front and rear portions.

Still further, only if the user moves the front drawer forward and downward, the rear drawer can slide in communication with the front drawer. Accordingly, it is convenient for the user to use the drawers.

Still further, when it is rotated and moved forward and downward, the front drawer may be supported by the rear drawer or the rail unit via the link unit and maintain the supported state.

Still further, when the front drawer is supported by the rear drawer via the link unit, the maximum moved position of the rear drawer may be determined by the stopper provided in the rail unit.

Still further, when the front drawer is supported by the rail unit via the link unit, the maximum moved position of the rear drawer may determined by the front drawer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

DESCRIPTION OF SPECIFIC EMBODIMENTS

Exemplary embodiments of the disclosed subject matter are described more fully hereinafter with reference to the accompanying drawings. The disclosed subject matter may, however, be embodied in many different forms and should not be construed as limited to the exemplary embodiments set forth herein.

Figure 1:
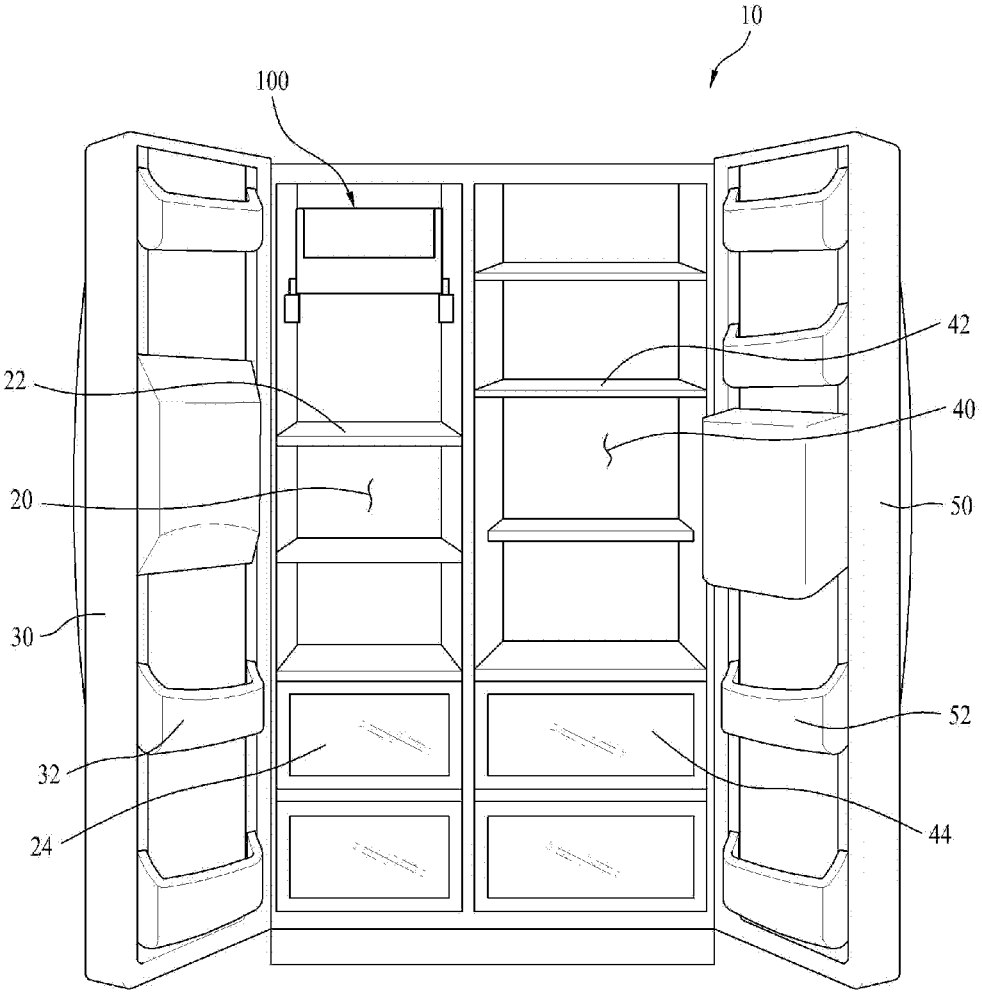
FIG. 1 is a front perspective diagram illustrating a refrigerator according to one embodiment of the present disclosure.

FIG. 1 is a front perspective diagram illustrating a refrigerator according to one embodiment of the present disclosure.

As shown in FIG. 1, the refrigerator consists of a freezer compartment 20 and a refrigerator compartment 40 which are provided in left and right areas inside a cabinet 10, respectively, as storage chambers.

The freezer compartment 20 and the refrigerator compartment 40 are open and closed by a freezer door 30 and a refrigerator door 50 rotatably coupled to sides thereof, respectively.

A plurality of shelves 22 and a plurality of retractable drawers 24 may be arranged in the freezer compartment 20.

Also, a plurality of shelves 42 and a plurality of retractable drawers 24 may be arranged in the refrigerator compartment 40.

To utilize a storage space inside the storage chamber efficiently, a plurality of shelves 32 and 52 may be typically arranged in the freezer door 30 and the refrigerator door 50, respectively.

It is a technical feature of the present disclosure that a forward/downward movable drawer assembly 100 may be provided in an upper area inside the freezer compartment 20.

The drawer assembly 100 may be provided only in the upper area inside the freezer compartment 20. However, it may be provided in an upper area inside the refrigerator compartment 40 or each upper area of the freezer and refrigerator compartments 20 and 40.

The refrigerator shown in FIG. 1 is a side by side type refrigerator. However, the refrigerator of the present disclosure may be applied to a bottom freezer type refrigerator or a top mount type refrigerator only if a top area of a refrigerator or freezer compartment is higher than the height of an average man.

Figure 2:
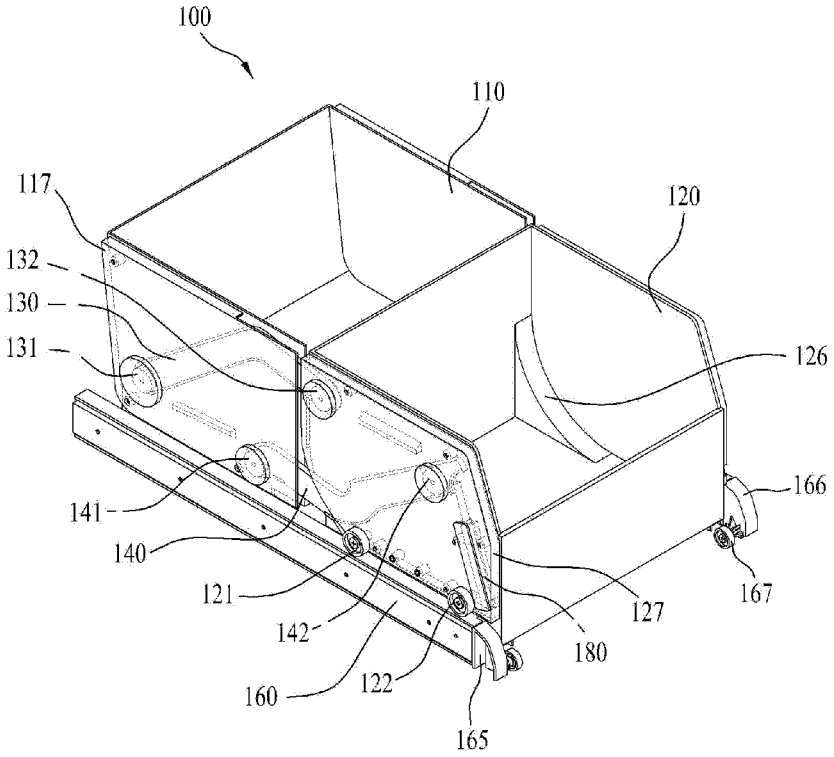
FIG. 2 is a perspective diagram illustrating a drawer assembly according to a first embodiment of the present disclosure.
Figure 3:
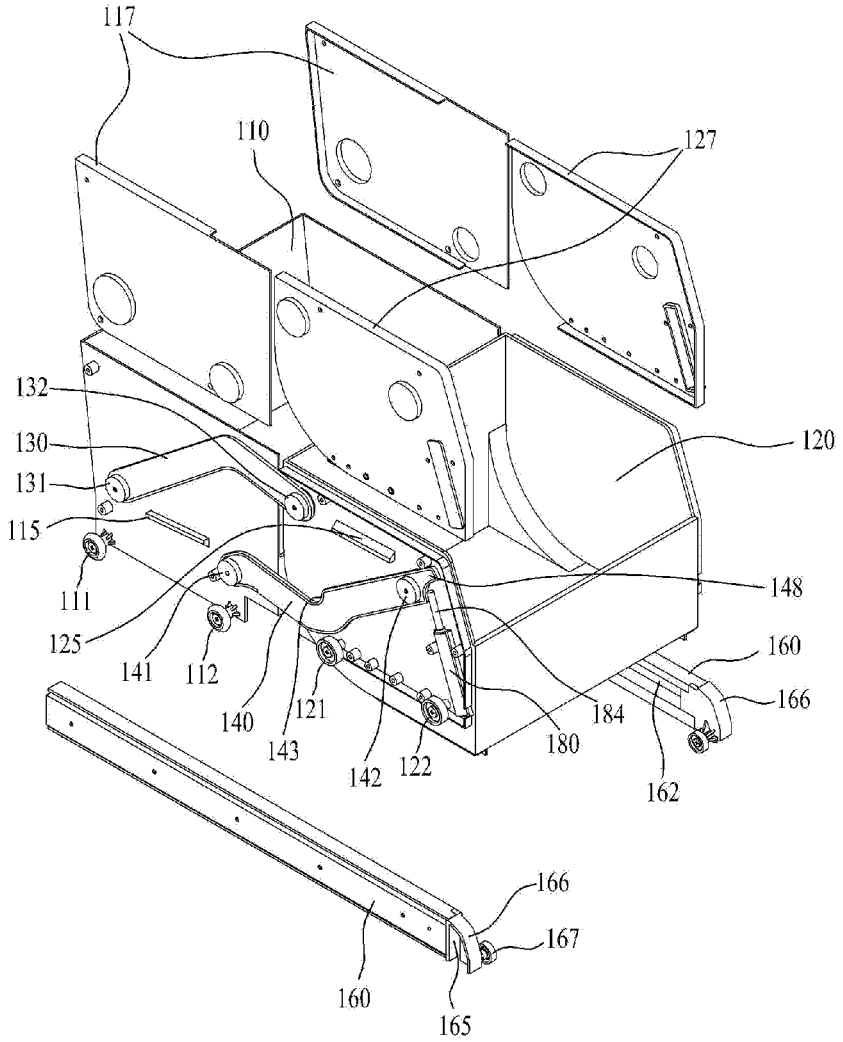
FIG. 3 is an exploded perspective diagram of the drawer assembly shown in FIG. 2.

FIG. 2 is a perspective diagram illustrating a drawer assembly 100 according to a first embodiment of the present disclosure and FIG. 3 is an exploded perspective diagram of the drawer assembly shown in FIG. 2.

The drawer assembly 100 includes a first drawer 110 arranged in an upper back area inside a storage chamber and a second drawer 120 arranged in an upper front area. In other words, the second drawer 120 may be in front of the first drawer 110.

The drawer assembly 100 may be provided in the storage chamber, in other words, an upper area inside the freezer compartment 20 or the refrigerator compartment 40. Specifically, the drawer assembly 100 may be provided in an uppermost area inside the freezer compartment 20 or the refrigerator compartment 40.

It is necessary to provide the drawer assembly 100 retractable in the storage chamber, with at least one drawer which is movable downward, in the uppermost area inside the storage chamber in a functional aspect. However, the position of the drawer assembly 100 is not limited to the uppermost area of the storage chamber.

In case a traverse depth of the storage chamber is large, the drawer assembly according to the present disclosure is provided in the storage chamber to utilize the space of the storage chamber efficiently and it is necessary to provide a user with easy access to the space of the other rear drawer.

Accordingly, the drawer assembly according to the present disclosure may be usually provided in the upper area of the storage chamber, when the storage chamber of the freezer compartment 20 or the refrigerator compartment 40 is formed longitudinally.

The first drawer 110 may be installed to move back and forth and the second drawer 120 may be installed to move forward and downward.

For that, the first drawer 110 and the second drawer 120 may be connected by a link unit 130 and 140 such that the second drawer 120 may relatively move with respect to the first drawer 110.

A pair of rail units 160 may be provided in both lateral walls of the storage chamber to guide and support rollers 111, 112, 121 and 122 provided in bottoms of the drawers 110, respectively.

The first drawer 110 may be formed in a rectangular box shape with an open top and it is preferred that a predetermined upper portion of the front is open.

Also, the second drawer 120 may be formed in a rectangular box shape with an open top and it is preferred that an upper area of the top is open and that a lower area of the top is closed by a front wall.

A front upper corner of a lateral surface possessed by the second drawer 120 may be trimmed to enhance user accessibility.

The link unit 130 and 140 is connectedly provided between the first drawer 110 and the second drawer 120 to rotate the second drawer 120 such that the rotated second drawer 120 may relatively move with respect to the first drawer 110 downward. The link unit may include a first link 130 and a second link 140.

The first link 130 may be connectedly provided between a rear lower portion of an outer lateral surface possessed by the first drawer 110 and a rear upper portion of an outer lateral surface possessed by the second drawer 120. The pair of the first links 140 may be provided in symmetry.

The connected portion between the first link 130 and the rear lower portion of the outer lateral surface of the first drawer 110 may be referenced to as a first shaft 131 and the connected portion between the first link 130 and the rear upper portion of the outer lateral surface of the second drawer 120 may be referenced to as a second shaft 132.

The second link 140 may be connectedly provided between a front lower portion of an outer lateral surface possessed by the first drawer 110 and a front upper portion of an outer lateral surface of the second drawer 120. The pair of the second links 140 may be provided in symmetry.

The connected portion between the second link 140 and the front lower portion of the outer lateral surface possessed by the first drawer 110 may be referenced to as a first shaft 141. The connected portion between the second link 140 and the front upper portion of the outer lateral surface possessed by the second drawer 120 may be referenced to as a second shaft 142.

The first link 130 may be bent upward and the second link 140 may be bent downward.

When the second drawer 120 is moved lowest downwardly, the first link 130 and the second link 140 may be bent symmetrically such that a front portion of the first link 130 can be supported by a rear portion of the second link 140.

Accordingly, when the second drawer 120 is moved lowest downwardly, the second shaft 132 of the first link 130 may be supported by the first shaft 141 of the second link 140 in contact.

A concave portion 143 may be provided in an upper middle surface of the second link 140 to seat the second shaft 132 of the first link 130 thereon.

The concave portion 143 may restrict a rotational angle of the first link 130 and the second link 140 so as not to rotate any further once they are rotated to the maximum. The relative position of the second drawer 120 with respect to the first drawer 110 is maintained by the restricted first and second links 130 and 140.

The first link 130 may be convexly bent upward and the second link 140 is convexly bent downward, such that the downward moving distance of the second drawer 120 can be increased when the second drawer 120 rotates and moves downward.

The first drawer 110 may include a first stopper 115 to restrict a rotation angle at a lower portion of the first drawer, when the first link 130 is rotated downward.

The first link 130 may be rotatably connected between the outer lateral surfaces of the first drawer 110 and the second drawer 120. The first link 130 provided in a left portion of the first drawer 110 is rotated in a clockwise direction together with the second drawer 120 rotated downward by the standard of the shaft coupled to the first drawer 110.

The first stopper 115 may be a rib projected from a lower central portion of the outer lateral surface possessed by the first drawer 110.

The first link 130 may rotatably be connected to the outer surfaces of the first drawer 110 and the second drawer 120. The second link 140 provided in a left portion of the second drawer 120 may be rotated in a counter-clockwise direction together with the second drawer 120 moved downward, by the standard of the shaft coupled to the first drawer 120.

The second stopper 125 may be a rib projected from an upper central portion of the outer surface possessed by the second drawer 120.

The first stopper 115 and the second stopper 125 may be formed in both sides of the outer surface possessed by each drawer, like the first link 130 and the second link 140.

Various storable foods may be held in the first drawer 110 and the second drawer 120. Especially, the second drawer 120 may move downward and be supported by the first drawer 110 by the link unit 130 and 140.

Specifically, unless the user moves the second drawer 120 which is heavy because of the stored foods downward gently, with holding the second drawer 120, there might be damage to the link unit 130 and 140, the second drawer 120 and the first and second stoppers 115 and 125.

To relieve the shock generated by the downward moving second drawer 120, a damper 180 pressed by the rotating second link 140 may be provided in a predetermined portion of the outer surface possessed by the second drawer 120.

The damper 180 may be provided in a front lower portion of the second drawer 120 and a damping projection 148 may be formed in an end of the second link 140 to press the damper 180 selectively.

Specifically, the damping projection 148 may be extended in the reverse direction of the shaft of the second link 140 to the second drawer 120. The damping projection 148 may be formed in a proper shape, considering a pressed degree of a damping rod 184 provided in the damper 180 when the second drawer 120 is moving downward.

The damper may allow the second drawer 120 to move downward gently when the user pulls the second drawer 120 to move downward and prevent damage to parts of the drawer.

The pair of the rails 160 may be fixed to both lateral walls of the storage chamber by screws, respectively.

The pair of the rails 160 may be formed in symmetry and a cross section of each rail may be "ㄷ"-shaped.

The first drawer 110 and the second drawer 120 are supported by the pair of the slides and they are able to slide along the pair of the rails 160. A plurality of rollers may be provided in each of the drawers to reduce friction between the drawer and the rail.

Two pairs of first rollers 111 and 112 provided in both lower ends of the first drawer 110 may consist of a pair of rear rollers 111 arranged in a rear portion of the lower end and a pair of front rollers 112 arranged in a front portion of the lower end of the first drawer 110.

The two pairs of the rollers 111 and 112 may be insertedly supported by the ㄷ-shaped rail 160.

Grooves formed in the pair of the rails 160 may be referenced to as guide grooves 162 for guiding the two pairs of the first rollers 111 and 112.

The two pairs of the second rollers 121 and 122 provided in both lower ends of the second drawer 120 may consist of a pair of rear rollers 121 arranged in a rear portion of the lower end and a pair of rollers 122 arranged in a front portion of the lower end of the second drawer 120.

The two pairs of the second rollers 121 and 122 may be supported by an upper surface of the ㄷ-shaped rail unit 160, such that they may be arranged higher than the two pairs of the first rollers 111 and 112.

As shown in FIG. 3, an outer circumferential surface of the second roller 121 and 122 may be formed level in a traverse direction and an outer circumferential surface of the first roller 111 and 121 may be formed circular in a traverse direction.

A guide groove 162 of the rail unit 160 may be formed in circular shape, corresponding to the shape of the outer circumferential surface of the first roller 111 and 112.

The profile of the first roller and the guide groove 162 may be formed circular, such that the first roller 111 and 121 cannot move to the shaft. Accordingly, the first drawer 110 may be prevented from moving leftward/rightward.

When the second drawer 120 is moved downward, the first drawer 110 supports the second drawer 120, with restricting the lowest position. The rail unit 160 may further include a third stopper 165 provided in the end thereof to hook the front rollers 112 moving forward.

The third stopper 165 restricts the front rollers 112 from moving forward farther by supporting the front rollers 112 of the first drawer 110, when the second drawer 120 moves downward.

An inclined curvature 166 may be formed in a front end of the rail unit 160 to support and guide the rear rollers 121 of the second rollers selectively, when the second drawer 120 is moved downward.

As shown in FIGS. 2 and 3, the inclined curvature 166 may be formed in a front surface of the third stopper 165 insertedly coupled to an end of the rail unit 160.

In this instance, the third stopper 165 may be formed as an independent member from the rail unit 160 and one end of the third stopper 165 may be fixedly inserted in the end of the rail unit 160.

The third stopper 165 and the inclined curvature 166 may be bent or projected from the rail unit 160, not independent members. They may be integrally formed with the rail unit 160.

A roller 167 may be provided in the third stopper 165 forming a front end of the rail unit 160 so as to support both rear ends of the second drawer 120 when the second drawer 120 is moving downward.

Accordingly, a supported curvature 126 may be formed in each of both rear ends of the second drawer 120 to be supported by the roller 167 while the second drawer 120 is moving downward.

Together with the inclined curvature 166, the roller 167 may allow the second drawer to move downward smoothly.

As mentioned above, the pair of the first links 130 and the pair of the second links 140 may be arranged in both outer surfaces of the first and second drawers 110 and the 120.

The first links 130 and the second links 140 connectedly provided between the first drawer 110 and the second drawer 120 may be connected to the outer surfaces of the two drawers, such that the links can be exposed when the second drawer 120 is moving downward and forward simultaneously.

When the rotating links are exposed outside, there might be issues with safety and durability and also the exposed links might not look good externally.

Accordingly, the first drawer 110 and the second drawer 120 may further include a first cover 117 and a second cover 127 to cover the first link 160 and a second cover 127 to cover the second link 140, respectively.

The first cover 117 may be spaced apart a predetermined distance from each of both outer surfaces possessed by the first drawer 110, such that the first link 130 and the second link 140 may be rotatable between the first cover 117 and the outer surface of the first drawer 110.

The second cover 127 may be spaced apart a predetermined distance from each of outer surfaces possessed by the second drawer 120, such that the first link 130 and the second link 140 may be rotatable between the second cover 127 and the outer surface of the second drawer 120.

The first cover 117 and the second cover 127 may be coupled to the first drawer 110 and the second drawer 120 by a plurality of screws, respectively.

As shown in FIGS. 2 and 3, the first cover 117 and the second cover 127 may cover an outer surface and an inner surface of a lateral wall possessed by each of the first and second drawers 110 and 120.

The inner surfaces of the first cover 117 and the second cover 127 may form inner surfaces of the first drawer 110 and the second drawer 120, respectively.

The first link 130 and the second link 140 may be rotated between the outer surfaces of the covers and the outer surfaces of the drawers in a predetermined range of angles, such that the covers 117 and 127 may not interfere with the links 130 and 140.

Figure 4:
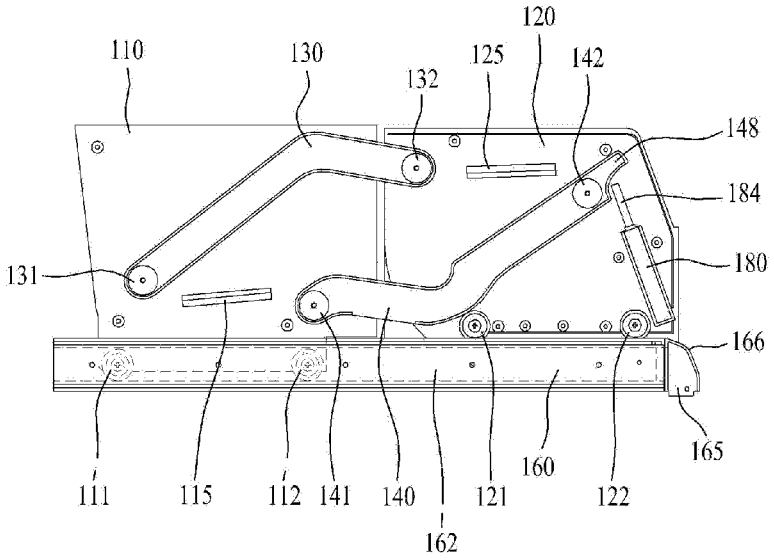
FIGS. 4 to 6 are side view illustrating an operation process of the drawer assembly shown in FIG. 2.
Figure 5:
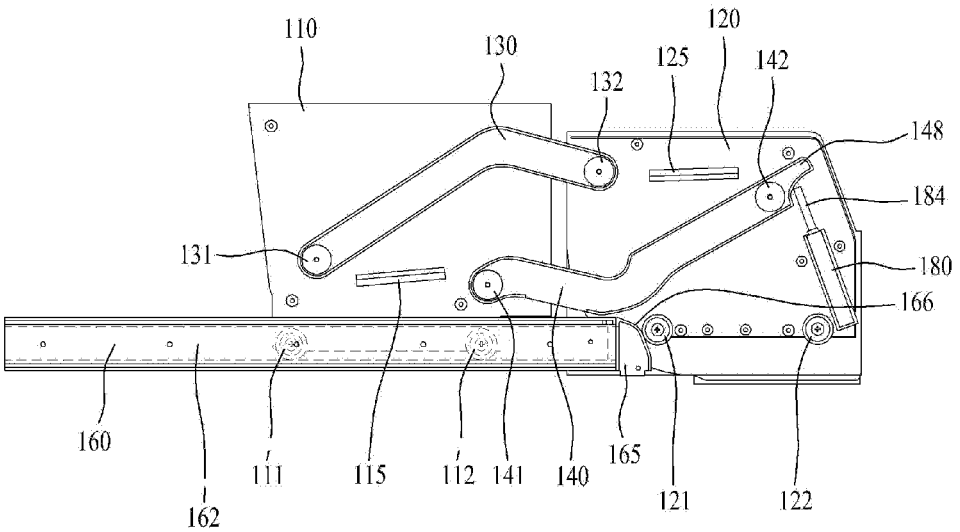
Figure 6:
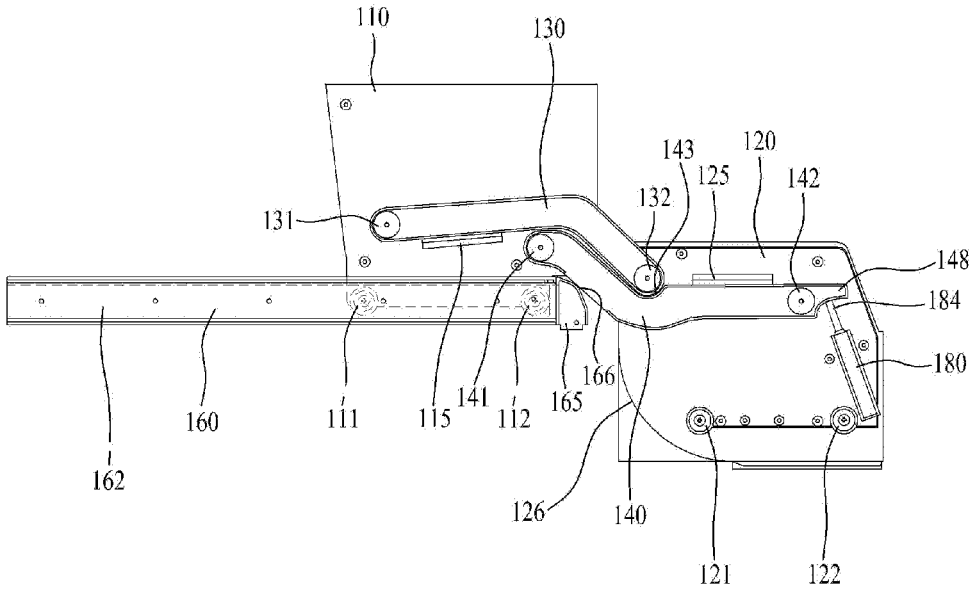

Referring to FIGS. 4, 5 and 6, an operation process of the drawer assembly in the refrigerator according to the first embodiment will be described.

FIG. 4 illustrates an initial state where the drawer assembly supported on the rail unit is positioned in the rear portion of the storage chamber FIG. 5 illustrates an intermediate state of the pulled drawer assembly. FIG. 6 illustrates a final state of the second drawer pulled completely with the second rawer moved downward.

As shown in FIG. 4, in the initial state of the drawer assembly 100, the first rollers 111 and 112 of the first drawer 110 may be supported by the inner rear portion of the rail unit 160 and the second rollers 121 and 122 of the second drawer 120 may be supported by a rear top surface of the rail unit 160.

At this time, a damping projection 148 formed in the second link 140 is spaced apart a predetermined distance, not in contact with the damping rod 184 of the damper 180.

When the user pulls the second drawer 120, the drawer assembly 100 may move to the intermediate state shown in FIG. 5.

Specifically, the vertical position of the second drawer 120 may not be changed before the first rollers 111 and 112 of the first drawer 110 are supported by the inner front portion of the rail unit 160 and before the rear roller 121 of the second rollers 121 and 122 of the second drawer 120 is supported by the inclined curvature 166 formed in the front end of the rail unit 160.

When the rear roller 121 is positioned on the inclined curvature 166 after that, the rear roller 121 rolls along the inclined curvature 166 and moves downward. At the same time, the first link 130 and the second link 140 rotates and the second drawer 120 moves downward, while maintaining a horizontal state.

At this time, the inclined curvature 166 guides the rear roller 121 to move downward smoothly such that the second drawer 120 may be prevented from falling drastically.

In the intermediate state shown in FIG. 5, the supported curvature 126 of the second drawer 120 is supported by the roller 167 formed in the third stopper 165 to guide the second drawer 120 moving downward smoothly.

Once the second drawer 120 is moved lower, a relative position of the second drawer 120 with respect to the first drawer 110 may be determined by the first link 130 and the second link 140.

The damping projection 148 of the second link 140 starts to press the damping rod 184 of the damper 180 in a predetermined range of rotation angles, while rotating.

The range of the rotation angles at which the damping projection 148 starts to press the damping rod 184 may be designed in consideration of the weight of the second drawer containing the stored foods and a damping coefficient of the damper 180.

Once the second drawer 120 is moved lowest, the second drawer 120 is supported to the first drawer 110 by the first link 130 and the second link 140, that is, the final state shown in FIG. 6.

At this time, the front roller 112 of the first drawer 110 is supported by the rear surface of the third stopper 165 and the rear roller 1111 of the first drawer 110 is supported by a ceiling of the guide groove 162 of the rail unit 160 having a cross section of "ㄷ"-shape.

The moment at which the second drawer 120 is hooked to the first drawer 110 by the first link 130 and the second link 14.

In such the final state, the damping projection 148 of the second link 140 presses the damping rod 184 to the maximum.

At the same time, the lower surface of the first link 130 is supported by the first stopper 115 and the upper surface of the second link 140 is supported by the second stopper 125.

The second shaft 132 of the first link 130 is supported by the first shaft 141 of the second link 140, such that the second shaft 132 of the first link 130 may be supported by the concave portion 143 of the second link 140.

In case the user pushes the drawer assembly 100 again to restitute the drawer assembly 100, the pulling process mentioned above may be performed in reverse order.

Especially, in the intermediate state, the rear roller 121 of the second drawer 120 ascends along the inclined curvature 166 supportedly. When the supported curvature 126 of the second drawer 120 is pushed upward to be supported by the roller 167 formed in the third stopper 165, the drawer assembly 100 can be shut smoothly.

In the refrigerator according to the first embodiment, the drawer assembly which is movable downward and forward may be provided in the storage chamber and it can be convenient for the user to place or take out the foods smoothly.

When the user pulls a second shelf from the drawer assembly according to the first embodiment, a first shelf and a second shelf are sliding by the link unit connectedly provided between the first and second shelves and only the second shelf is then rotated and moved downward. When the second shelf is arranged at the lowest position, the first shelf is supported by the stopper of the rail unit and the second shelf is supported by the link.

Next, referring to FIGS. 7, 8, 9 and 10, a drawer assembly according to a second embodiment of the present disclosure will be described.

The biggest differences between a drawer assembly 200 according to this embodiment and the drawer assembly 100 according to the first embodiment mentioned above are connected positions and shapes of the links.

Figure 7:
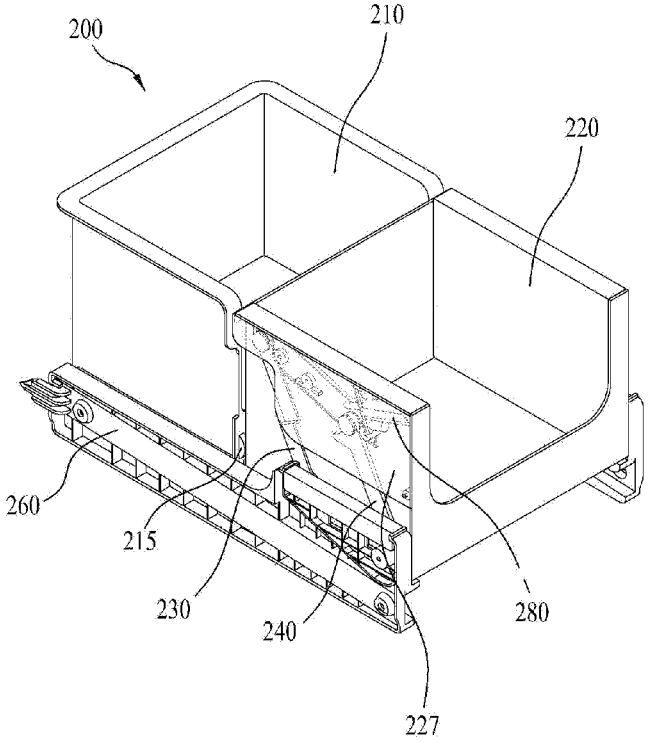
FIG. 7 is a perspective diagram illustrating a drawer assembly according to a second embodiment of the present disclosure.
Figure 8:
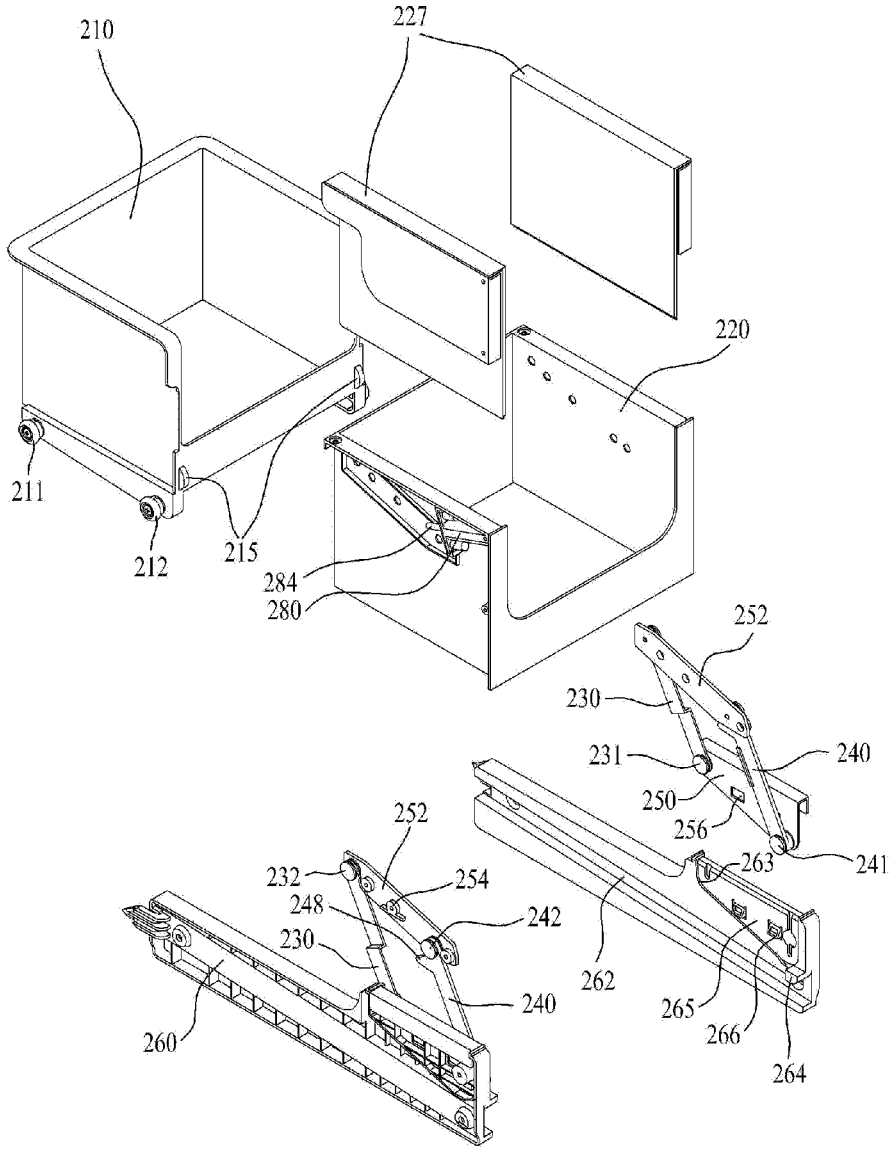
FIG. 8 is an exploded perspective diagram of the drawer assembly shown in FIG. 7.

FIG. 7 is a perspective diagram illustrating the drawer assembly according to the second embodiment of the present disclosure. FIG. 8 is an exploded perspective diagram of the drawer assembly shown in FIG. 7.

Like the first embodiment, the drawer assembly 200 according to this embodiment may be provided in the storage chamber, in other words, an upper portion (the uppermost portion) of the freezer compartment 20 or the refrigerator compartment 30.

The drawer assembly 200 may consist a first drawer 210 arranged in an upper rear portion inside the storage chamber and a second drawer 220 arranged in an upper front portion inside the storage chamber.

The first drawer 210 may be formed in a rectangular box shape with an open top and it is preferred that an upper area of the top is open and that a lower area of the top is closed by a front wall.

Also, the second drawer 320 may be formed in a rectangular box shape with an open top and it is preferred that an upper area of the top is open and that a lower area of the top is closed by a front wall.

A rail unit 260 may be provided in each inner surface of upper lateral walls to support the first drawer 210 and the second drawer 220 such that it may guide the motion of the first and second drawers 210 and 220.

Two pairs of rollers 211 and 212 may be provided in both lower portions of the first drawer 210, respectively.

The two pairs of the rollers may include a pair of rear rollers 211 arranged in a lower rear portion of the first drawer 210 and a pair of front rollers 212 arranged in a lower front portion of the first drawer 210.

A guide groove 262 may be formed in an inner surface of the rail unit 260 to supportingly insert the two pairs of the rollers 21 and 212 therein.

The guide groove 262 may be inclined a predetermined angle forward. When the second drawer 220 moves forward, the two pairs of the rollers 211 and 212 provided in the first drawer 210 may move forward along the guide groove 262 inclined by the gravity.

An inclination angle of the guide groove 262 may be determined appropriately in consideration of the weight of the first drawer 210 containing the stored foods and a coefficient of friction. For example, the guide groove 262 may be inclined approximately 3 degrees forward.

In this embodiment, the first drawer 210 and the second drawer 220 may not be connected with each other. A front surface of the first drawer 210 may be in contact with a rear surface of the second drawer 220 supportedly. The link unit 230 and 240 may be connectedly provided between the first drawer 210 and the rail unit 260.

A projection 215 may be projected from the front surface of the first drawer 210 to keep a gap with the rear surface of the second drawer, in contact with the rear surface.

The projection 215 may be formed in each of both portions of the rear surface corresponding to the extended portion from the rear surface of the second drawer 220.

A first link 230 of the link unit 230 and 240 may be connectedly provided between a rear upper portion of an outer surface possessed by the second drawer 220 and an inner surface of a middle portion possessed by the rail unit 260. The second link 240 may be connectedly provided between a central upper portion of an outer surface possessed by the second drawer 220 and a front inner surface of the rail unit 260.

Specifically, a lower shaft 231 of the first link 230 may be provided in an inner surface of the middle portion possessed by the rail unit 260. An upper shaft 232 of the first link 230 may be provided in a rear upper portion of the outer surface possessed by the second drawer 220.

A lower shaft 241 of the second link 240 may be provided in a front lateral surface of the rail unit 260. An upper shaft 242 of the second link 240 may be provided in a central upper portion of an outer surface possessed by the second drawer 220.

Especially, the second link 240 may be provided in parallel to the first link 230, a little bit lower than the first link 230.

The rotating links 230 and 240 may not interfere with each other.

The links 230 and 240 may be directly coupled to the rail unit 260. However, the links 230 and 240 may be coupled to each other via a coupling member 250 coupled to a coupling groove 265 formed in an inner front portion of the rail unit 260, in a state of where lower ends of the lines 230 and 240 are connected to each other.

A plurality of coupling holes 256 may be formed in a middle portion of the coupling member 250. Corresponding to the coupling holes 256, a plurality of coupling projections 266 may be formed in a middle portion of the coupling groove 265.

The coupling member 250 may be insertedly coupled to the coupling groove 265 of the rail unit 260 fixed to the inner surface of the storage chamber in an up-and-down direction, in a state where the links 230 and 240 are connected with each other.

Upper ends of the links 230 and 240 may be coupled to a predetermined portion of the second drawer 220 directly. However, a connecting member 252 may be further provided to couple the upper ends of the links 230 and 240 thereto.

A plurality of coupling holes may be provided in the connecting member 252 and the coupling member may be coupled to an outer surface of the second drawer 220 by a screw.

The upper shaft 232 of the first link 230 and the upper shaft 242 of the second link 240 may be coupled to an outer portion of the connecting member 252. It is preferred that a stopper 254 is projected from the outer portion of the connecting member 252 to restrict the rotation of the second link 240.

The stopper restricts the rotation of the second link 240 not to rotate any further with respect to the upper shaft 232, when the second link 240 is rotated to the maximum to be horizontal after the second drawer 220 is moved lowest.

Also, a supporting surface 263 may be formed in a rear lateral surface of the coupling groove 265 and the supporting surface 263 may be inclined a predetermined angle, to support the first link 230 when the first link is arranged in an initial position.

The first link 230 may be supported by the supporting surface 263 such that the second drawer 220 may maintain an initial state by using the first link 230 and the second link 240.

Supporting projections 264 may be projected from front inner ends of the pair of the rail units 260, facing each other. When the second link 240 is horizontal after rotating to the maximum, the supporting projections 264 may support the second drawer 220 from a lower direction.

The supporting projection 264 may prevent the second link 240 not to rotate any further so as to support the second drawer 220, when the supporting projection 264 is rotated to the maximum.

At this time, a pair of projections 215 may be formed in both front lateral portions of the first drawer 210 and the first drawer 210 may not be pulled forward by the pair of the projections 215 supported by the rear surface of the second drawer 220.

Hence, the rear roller 211 of the first drawer 210 may be supported by a ceiling of the guide groove 262 and the front roller 212 may be supported by a bottom of the guide groove 262. The projections 215 of the first drawer 210 may be supported by the rear surface of the second drawer 220. Accordingly, the first drawer 210 may be secured to a final position.

Meanwhile, the second drawer 220 may include a damper 280 to relieve a shock generated by the rotation of the second link when the second drawer 220 moves forward/downward.

As shown in FIG. 8, the damper 280 may be coupled to a front upper portion of the outer surface possessed by the second drawer 220. The damper 280 may be provided toward an eccentric position from the upper shaft 242 of the second link 240 and a damping rod 284 may be projected.

A damping projection 248 is formed adjacent to the upper shaft 242 of the second link 240 and the damping projection 248 selectively pushes the damping rod 284 while rotating.

The damping projection 248 pushes the damping rod 284, when the second link 240 during the forward/downward motion of the second drawer 220, and it pushes the damping rod 284 to the maximum, when the second link 240 is positioned horizontally.

An assembling process of the rail unit 260 and the drawers 210 and 220 will be described as follows.

First of all, the rail unit 260 is fixedly coupled to the inner lateral surface of the storage chamber. After that, the rollers 211 and 212 of the first drawer 210 are inserted in the guide groove 262 of the rail unit 260 and pushed to the rear portion.

Hence, the links 230 and 240 are coupled to the coupling member 250 and the connecting member 252 is connected thereto. The connecting member 252 may be connected to the outer lateral surface of the second drawer 220.

Lastly, the coupling member 250 may be coupled to the coupling groove 265 of the rail unit 260.

Figure 9:
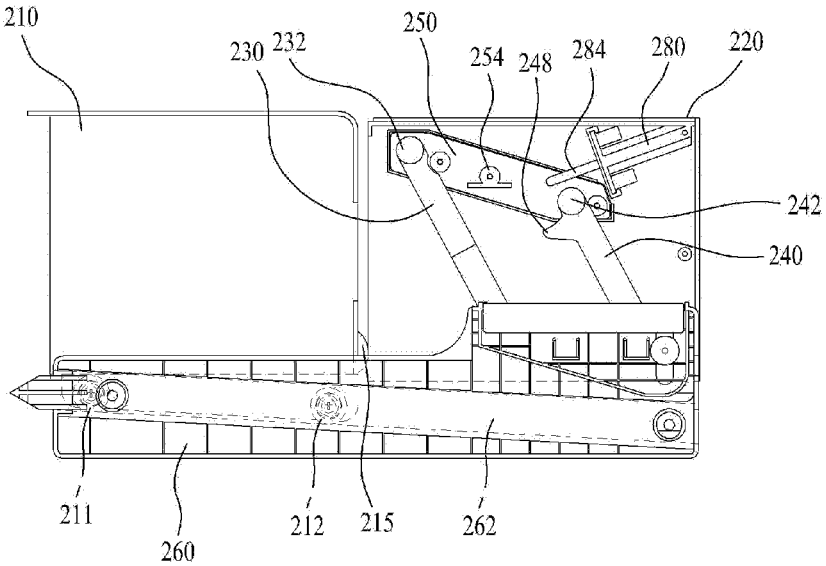
FIGS. 9 and 10 are side views illustrating an operation process of the drawer assembly shown in FIG. 7.
Figure 10:
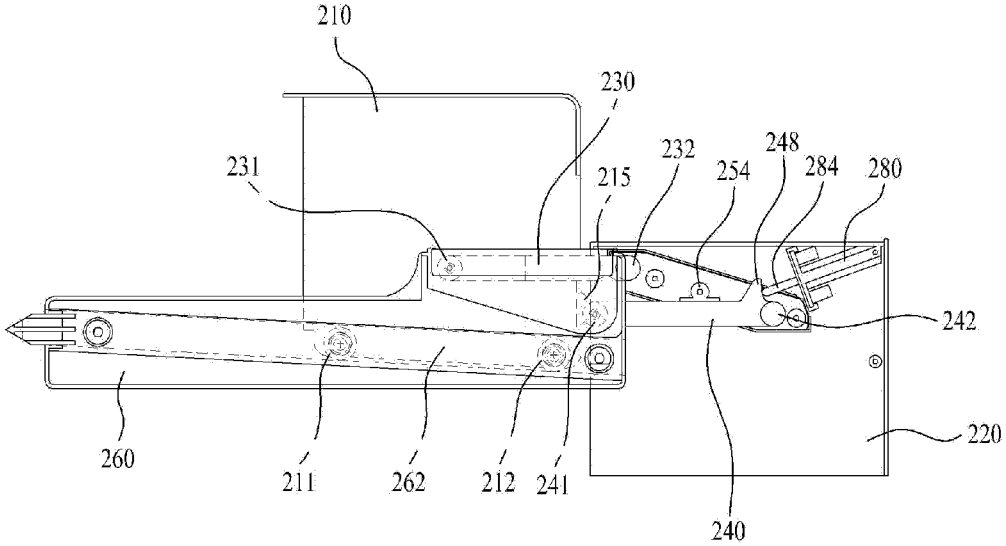

Referring to FIGS. 9 and 10, an operation of the drawer assembly according to the second embodiment will be described.

FIG. 9 illustrates an initial state of the drawer assembly 200 and FIG. 10 illustrates a final state of the drawer assembly 200.

First of all, in the initial state shown in FIG. 9, the rollers 211 and 212 of the first drawer 210 are supported by the guide groove 262 of the rail unit 260. The second drawer 220 is supported by the links 230 and 240.

At this time, a lateral surface of the lower end possessed by the first link 230 is supported by the supporting surface (263, see FIG. 8) of the coupling groove 265, only to maintain the initial state.

Once the user pulls the second drawer 220, the two pairs of the links 230 and 240 rotate and the second drawer 220 moves forward/downward, with maintaining a horizontal state.

As the second drawer 220 is moved forward, the first drawer 210 is also moved forward by the gravity because of the inclined guide groove 262.

The damping projection 248 starts to press the damping rod 284 of the damper 280 when the second link 240 reaches a position distant a predetermined angle during the downward motion of the second drawer 220.

Once the user rotates the second drawer 220 to the maximum, it is in the final state shown in FIG. 10.

In the final state, the second drawer 220 is supportedly hung on the two pairs of the links 230 and 240 and one surface (a lower surface in FIG. 10) of the second link 240 is supported to the supporting projection 264 and the other surface (an upper surface in FIG. 10) is supported by the stopper 254.

At this time, the damping projection 248 of the second link 240 presses the damping rod 284 of the damper 280 to the maximum.

Also, the first drawer 210 is supported in a state where the second drawer 220 is fixed, such that the projection 215 formed in the front surface of the first drawer may contact with the rear surface of the second drawer 220 to keep the supported state.

In the drawer assembly according to the second embodiment of the present disclosure, the two drawers arranged in traverse direction may be pulled forward and the front one of the drawers may move downward. Accordingly, the user can take out the stored foods from the rear drawer as well as the front drawer easily and place foods in the rear drawer as well as the front drawer easily.

Furthermore, the drawer assembly according to the second embodiment has a simpler structure than the drawer assembly according to the first embodiment. Accordingly, it has a lower production cost and an easy assembling efficiency.

Still further, the second drawer of the drawer assembly may be directly to the rail unit via the link unit and it may rotate only with respect to the rail unit. Accordingly, the second drawer may be supported more stably and a supporting force can be increased.

Still further, once the user lowers the second drawer by rotating the second drawer, the first drawer may slide forward along the guide of the inclined guide groove of the rail unit. Once the user rotates and raises the second drawer again, the first drawer may be pushed backward by the second drawer.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet;

a door that is rotatably coupled to the cabinet and that is configured to rotate about a vertical axis;

a storage chamber located within the cabinet;

a first drawer located in the storage chamber at a rear position and configured to move to a front position;

a second drawer arranged in front of the first drawer and configured to move forward and downward;

a rail unit fixed inside the cabinet and configured to support the first drawer and the second drawer and guide movement of the first drawer and the second drawer, wherein the first drawer and the second drawer are arranged on a back portion and a front portion of the rail unit, respectively; and a link unit comprising a first link and a second link pivotably connected to the second drawer, wherein, based on the door being oriented in a closed position, the first link and the second link are located in the storage chamber.

2. The refrigerator according to claim 1, wherein:

the first link is connected between a lateral wall of the first drawer and a lateral wall of the second drawer; and the second link is connected between the lateral wall of the first drawer and the lateral wall of the second drawer.

3. The refrigerator according to claim 2, wherein the first link is bent upward in a convex manner and the second link is bent downward in a convex manner.

4. The refrigerator according to claim 3, wherein the first drawer comprises a first stopper having a rib projected from an outer surface of the lateral wall of the first drawer and configured to restrict a rotation angle through which the first link is able to rotate downward, and the second drawer comprises a second stopper having a rib projected from an outer surface of the lateral wall of the second drawer and configured to restrict a rotation angle through which the second link is able to rotate downward.

5. The refrigerator according to claim 2, wherein the second drawer comprises a damper provided on the lateral wall of the second drawer and configured to dampen a shock generated by rotation of the second link that occurs based on the second drawer moving forward and downward to the front position.

6. The refrigerator according to claim 3, wherein the second link further comprises a concave portion configured to support one end of the first link based on the second drawer being moved forward and downward to the front position.

7. The refrigerator according to claim 2, wherein the first drawer comprises a first roller that is inserted in and supported by the rail unit.

8. The refrigerator according to claim 7, wherein the rail unit comprises a guide groove defined in an inner surface of the rail unit, the guide groove being configured to receive and guide the first roller.

9. The refrigerator according to claim 8, wherein the second drawer comprises a second roller supported by an upper surface of the rail unit.

10. The refrigerator according to claim 9, wherein the rail unit further comprises a stopper located at one end thereof and configured to restrict forward movement of the first roller at a maximum forward position of the first roller.

11. The refrigerator according to claim 10, wherein the rail unit includes an inclined curvature at a front end of the rail unit, the inclined curvature being configured to guide movement of the second roller as the second roller moves downward based on the second drawer moving to the front position.

12. The refrigerator according to claim 2, wherein the first link and the second link are located at outer lateral surfaces of the first drawer and the second drawer, and the first drawer and the second drawer comprise a first cover and a second cover configured to cover the first link and the second link, respectively, and the first cover and the second cover are configured to avoid interference with the first link and the second link, respectively.

13. The refrigerator according to claim 1, wherein the link unit comprises two links that are oriented in parallel to each other and that are connected between an outer lateral surface of the second drawer and an inner lateral surface of the rail unit.

14. The refrigerator according to claim 13, wherein:

the first link is connected between a lateral surface of the second drawer and an inner lateral surface of the rail unit; and the second link is connected between the lateral surface of the second drawer and the inner lateral surface of the rail unit, the second link being oriented in parallel to the first link and arranged lower than the first link.

15. The refrigerator according to claim 14, wherein the rail unit comprises:

a supporting projection configured to support the second link based on the second drawer being moved forward and downward to the front position.

16. The refrigerator according to claim 15, wherein the first drawer comprises a plurality of rollers supported by the rail unit.

17. The refrigerator according to claim 16, wherein a guide groove is defined in the rail unit, the guide groove being configured to receive the plurality of the rollers and the guide groove being inclined a predetermined angle forward.

18. The refrigerator according to claim 14, wherein the second drawer comprises a damper provided on the lateral wall of the second drawer and configured to dampen rotation force of the second link based on the second drawer being moved forward and downward to the front position.

19. The refrigerator according to claim 18, wherein the second drawer comprises a cover located at an outer lateral surface thereof and configured to cover a portion of the link unit and the damper.

20. The refrigerator according to claim 13, wherein the first drawer and the second drawer each have a rectangular box shape with an open top, and portions of front surfaces of the first drawer and the second drawer are open.

* * * * *